US011581649B2

(12) United States Patent
Kaneko et al.

(10) Patent No.: US 11,581,649 B2
(45) Date of Patent: Feb. 14, 2023

(54) SUBSTRATE-TYPE ANTENNA FOR GLOBAL NAVIGATION SATELLITE SYSTEM

(71) Applicants: Nissei Limited, Tokyo (JP); Faverights, Inc., Nagano (JP)

(72) Inventors: Tutomu Kaneko, Tokyo (JP); Takahisa Karakama, Nagano (JP)

(73) Assignees: Nissei Limited, Tokyo (JP); Faverights, Inc., Nagano (JP)

( * ) Notice: Subject to any disclaimer, the term of this patent is extended or adjusted under 35 U.S.C. 154(b) by 18 days.

(21) Appl. No.: 17/487,701

(22) Filed: Sep. 28, 2021

(65) Prior Publication Data

US 2022/0102858 A1 Mar. 31, 2022

(30) Foreign Application Priority Data

Sep. 28, 2020 (JP) ..... JP2020-161623

(51) Int. Cl.
*H01Q 1/28* (2006.01)
*H01Q 9/04* (2006.01)
(Continued)

(52) U.S. Cl.
CPC ..... *H01Q 5/50* (2015.01); *H01Q 1/288* (2013.01); *H01Q 9/0492* (2013.01); *H01Q 9/27* (2013.01); *H01Q 1/3233* (2013.01)

(58) Field of Classification Search
CPC ..... H01Q 9/285; H01Q 9/27; H01Q 21/30; H01Q 25/00; H01Q 15/24; H01Q 9/0428; H01Q 9/0464; H01Q 5/50; H01Q 1/3233; H01Q 1/38; H01Q 21/0006; H01Q 21/28; H01Q 5/40; H01Q 9/0492; H01Q 1/288
See application file for complete search history.

(56) References Cited

U.S. PATENT DOCUMENTS 8,681,069 B2 * 3/2014 Kaneko ..... H01Q 5/35 343/700 MS
10,651,548 B2 * 5/2020 Kaneko ..... H01Q 9/27
(Continued)

FOREIGN PATENT DOCUMENTS

JP H04281604 A 10/1992
JP 2012199878 A 10/2012
(Continued)

*Primary Examiner* — Vibol Tan
(74) *Attorney, Agent, or Firm* — von Briesen & Roper, s.c.

(57) ABSTRACT

Provided is an antenna for receiving radio waves including frequencies in the L6 band unique to QZSS to realize accurate positioning by QZSS. A substrate-type antenna 1 comprises an arcuate antenna element 20 including a long arcuate antenna element 22 and a short arcuate antenna element 24, each of which includes an integral antenna element compatible with three frequency bands and a single antenna element compatible with one frequency band and arranged with a space from the integral antenna element. Each of the integral antenna element and the single antenna element extends from an outer peripheral part of the arcuate antenna element toward an inner peripheral part thereof. The substrate-type antenna 1 further comprises a plurality of connection units 34 connected to the long arcuate antenna element 22 and the short arcuate antenna element 24, respectively, and a coupler 30 to which the plurality of connection units 34 is coupled.

3 Claims, 9 Drawing Sheets

(51) Int. Cl.

| | |
|---|---|
| ***H01Q 5/50*** | (2015.01) |
| ***H01Q 9/27*** | (2006.01) |
| *H01Q 1/32* | (2006.01) |

(56) References Cited

U.S. PATENT DOCUMENTS

| | | | | |
|---|---|---|---|---|
| 10,784,590 | B2 * | 9/2020 | Maccabe | H01Q 21/061 |
| 11,387,555 | B2 * | 7/2022 | Kaufmann | H01Q 5/50 |
| 2012/0242559 | A1 | 9/2012 | Kaneko et al. | |
| 2017/0365918 | A1 * | 12/2017 | Kaneko | H01Q 1/523 |

FOREIGN PATENT DOCUMENTS

| | | | |
|---|---|---|---|
| JP | 2017228871 | A | 12/2017 |
| JP | 2020161623 | A | 10/2020 |

* cited by examiner

FIG. 9

| SATELLITE SYSTEM | Band | FREQUENCY [MHz] | MAXIMUM VALUE [dBic] | AVERAGE VALUE [dBic] | AXIAL RATIO (AR) [dB] |
|---|---|---|---|---|---|
| GPS/QZSS | L5 | 1176.45 | 2.10 | 0.89 | 2.63 |
| GPS/QZSS | L2 | 1227.60 | 2.39 | 1.49 | 2.22 |
| QZSS | L6 | 1278.75 | 1.77 | 0.75 | 1.75 |
| GPS/QZSS | L1 | 1575.42 | 0.20 | -0.67 | 1.60 |

SUBSTRATE-TYPE ANTENNA FOR GLOBAL NAVIGATION SATELLITE SYSTEM

TECHNICAL FIELD

The present invention relates to a substrate-type antenna for a global navigation satellite system.

BACKGROUND ART

Recently, in the field of mobile communication such as mobile phones, for example, automatic driving technology for self-driving vehicles and remote control systems allowing an operator to remotely control mechanical facilities placed at a work site while monitoring images thereof from a remote location have been realized. These technologies can be realized by a combination of high-speed, high-capacity, and reliable low-latency communication introduced by a fifth-generation mobile communication system (hereinafter referred to as "5G or 5G services") and accurate positioning capable of suppressing mobile communication positioning errors to a few centimeters. The accurate positioning above can be delivered by the Japanese Quasi Zenith Satellite System "Michibiki" (hereinafter referred to as "QZSS"), which has been fully in operation with the global navigation satellite systems (hereinafter referred to as "GNSS").

Patent Literature 1 discloses a spiral antenna comprising: an upper insulation layer and a lower insulation layer that are interposed between an upper external conductor and a lower external conductor; an opening that is formed by removing an appropriate range portion of the upper external conductor, a radiation element that is formed by a spiral conductor, whose shape corresponds to the opening, and provided between the lower insulation layer and the upper insulation layer; and an internal conductor that is interposed between the upper insulation layer and the lower insulation layer and is connected to the radiation element formed by the spiral conductor for communication using high-frequency. In Patent Literature 1, the spiral antenna makes use of a dipole antenna element shape employing two antenna elements to receive circularly polarized waves, however, it does not take measures for being compatible with multi-band by combining a plurality of frequency bands, which is necessary to realize accurate positioning, and measures for reducing the phase difference between each frequency band.

Patent Literature 2 discloses a substrate type antenna comprising: a loop-like first joint pattern one spot of which is divided, said first joint pattern being formed in one substrate surface of a substrate comprised of a dielectric material; antennas respectively connected to both end terminals of the first joint pattern at a position where the first joint pattern is divided; a loop-like second joint pattern which is formed at a position opposite to the first joint pattern and has feeding points, and one spot of which is divided, said second joint pattern being formed in a backside substrate surface of the substrate; at least another loop-like joint pattern one spot of which is divided, said loop-like joint pattern being formed at a position opposite to the second joint pattern; and other antennas respectively connected to both end terminals of said another joint pattern at a position where said another joint pattern is divided, wherein the antennas connected to the first joint pattern and said other antennas connected to said another joint pattern are made different in resonant frequency. The substrate type antenna according to Patent Literature 2 is an antenna compatible with multi-band, however, it does not take measures for being compatible with multi-band by combining a plurality of frequency bands, which is necessary to realize accurate positioning, and for reducing the phase difference between each frequency band.

Patent Literature 3 discloses a substrate type antenna for conducting signal transmitting/receiving with using two antennas, each having almost same resonance frequency, wherein each of those two antennas applies therein a spiral antenna having an antenna side coupling pattern, which is positioned to face to a power supply point side coupling pattern, and a spiral antenna having a spiral antenna pattern, which is coupled to said side coupling pattern, and wherein those two antennas are positioned in such a manner that extending directions of the facing end portions, being closest to each other in said spiral antenna patterns of those two antennas, are not aligned to each other, but are shifted in different directions. The substrate type antenna according to Patent Literature 3 takes measures for preventing the interference from occurring between each antenna by using spiral shaped multi-band compatible antenna, however, it does not take measures for being compatible with multi-band by combining a plurality of frequency bands, which is necessary to realize accurate positioning, and for reducing the phase difference between each frequency band.

CITATION LIST

Patent Literature

[Patent Literature 1] JP-A-H04-281604
[Patent Literature 2] JP-A-2012-199878
[Patent Literature 3] JP-A-2017-228871

SUMMARY OF INVENTION

Technical Problem

In order to use QZSS, antennas compatible with, not only the L1 band (1575.42 MHz±15.35 MHz), the L2 band (1227.60 MHz±1.535 MHz), and the L5 band (1176.45 MHz±12.45 MHz) of the global positioning system (hereinafter, referred to as "GPS") operated by the United States, but also the L6 band (1278.75 MHz±21 MHz) unique to QZSS have been required.

An object of the present invention is to provide an antenna for receiving radio waves including frequencies in the L6 band unique to QZSS so as to realize accurate positioning by QZSS.

Solution to Problem

As a first aspect of the substrate-type antenna for a global navigation satellite system, the substrate-type antenna comprises: a substrate; and an arcuate antenna element that is compatible with a plurality of frequency bands, the arcuate antenna element being formed on one surface of the substrate, divided into two elements, and arranged around a center point of the substrate, the arcuate antenna element including a first arcuate antenna element and a second arcuate antenna element, each of the first arcuate antenna element and the second arcuate antenna element including an integral antenna element that is compatible with three frequency bands and a single antenna element that is compatible with one frequency band and is arranged with a space from the integral antenna element, each of the integral antenna element and the single antenna element being arranged to extend from an outer peripheral part of the arcuate antenna element toward an inner peripheral part thereof, and the substrate-type antenna further comprising a plurality of connection units connected to one end of the first arcuate antenna element and one end of the second arcuate antenna element, respectively, and a coupling portion to which the plurality of connection units is coupled, so as to configure a dipole antenna type circularly polarized antenna.

As a second aspect, in the substrate-type antenna for a global navigation satellite system according to the first aspect, the coupling portion has a shape of an ellipse, includes a plurality of coupling elements each of which is arranged with a space therebetween, and is formed such that a part of each of the plurality of coupling elements is divided and arranged with a space therebetween, and the coupling portion is connected to the first arcuate antenna element and the second arcuate antenna element, respectively, by the plurality of connection units.

As a third aspect, in the substrate-type antenna for a global navigation satellite system according to the first aspect or the second aspect, wherein a feeding coupling portion is provided on the other surface of the substrate which is an opposite side of the one surface so as to face the coupling portion, and gain received for each of the plurality of frequency bands is combined on the feeding coupling portion.

Advantageous Effects of Invention

The substrate-type antenna for a global navigation satellite system according to the first aspect can realize a multi-band antenna configured to combine and receive radio waves in four frequency bands including the L6 band unique to QZSS while eliminating reception of multipath radio waves at the time of accurate positioning by QZSS.

The substrate-type antenna for a global navigation satellite system according to the second aspect can collectively combine the gain due to the radio waves received by the substrate-type antenna for a global navigation satellite system from a satellite at one coupler.

The substrate-type antenna for a global navigation satellite system according to the third aspect can collectively combine the gain due to the radio waves received by the substrate-type antenna for a global navigation satellite system from a satellite at one feeding point.

BRIEF DESCRIPTION OF DRAWINGS

FIG. 9 illustrates a table chart indicating gain (dBic value) and an axial ratio (AR value) in each four frequency band of the substrate-type antenna for a global navigation satellite system according to the embodiment of the present invention.

DESCRIPTION OF EMBODIMENTS

Figure 1:
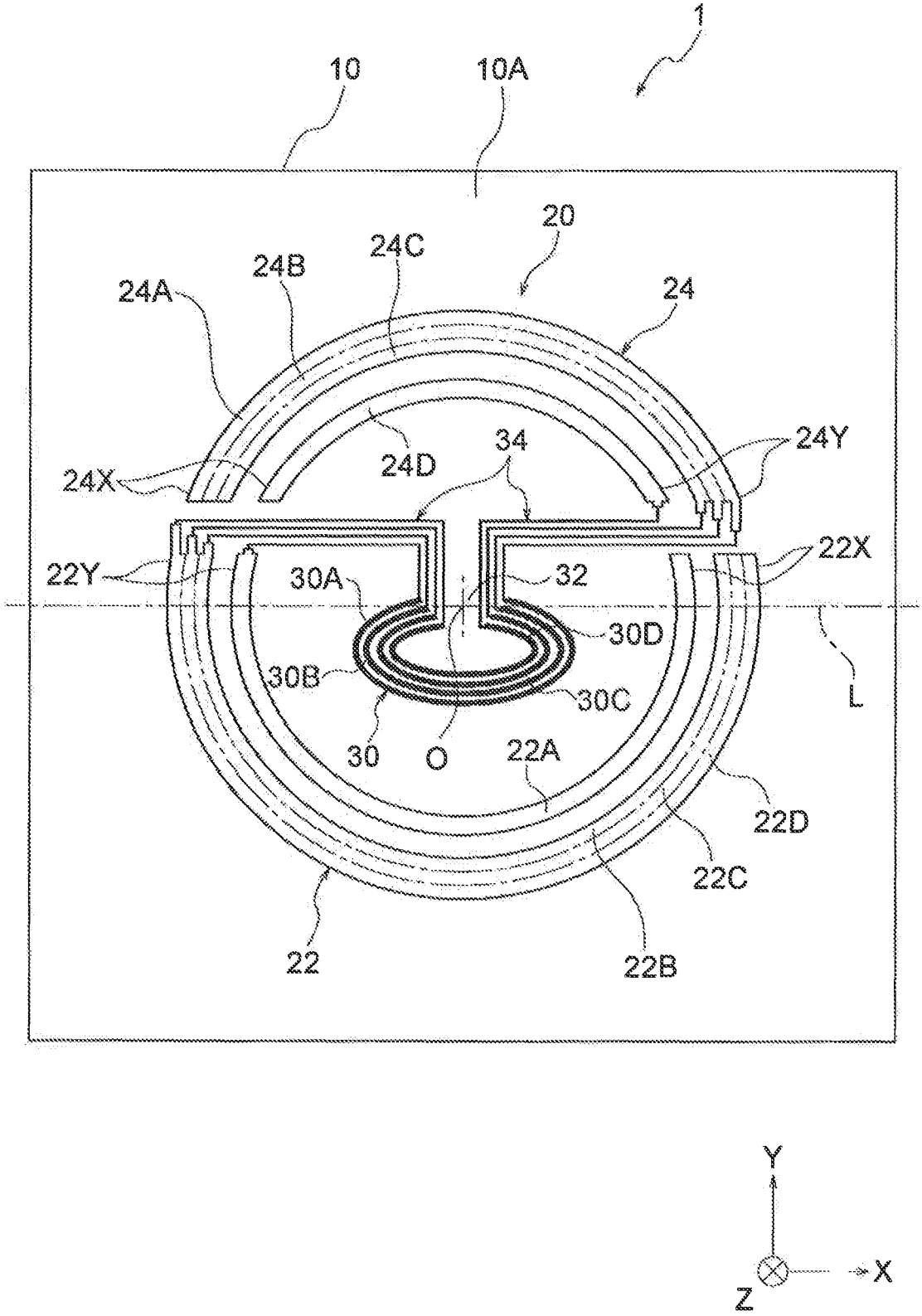
FIG. 1 is a plane view illustrating arrangement of antenna elements of a substrate-type antenna for a global navigation satellite system according to an embodiment of the present invention.

Hereinafter, an example of a substrate-type antenna for a global navigation satellite system (hereinafter, also simply referred to as a "substrate-type antenna") according to an embodiment of the present invention will be described with reference to FIG. 1 to FIG. 9. In the drawings, a direction indicated by the arrow X is a width direction of the substrate-type antenna or the substrate, a direction indicated by the arrow Y is a depth direction of the substrate-type antenna or the substrate, and a direction indicated by the arrow Z is a thickness direction of the substrate-type antenna or the substrate.

<Overall Configuration of Substrate-Type Antenna>

FIG. 1 illustrates an example of a configuration of a substrate-type antenna 1 according to the embodiment of the present invention.

As illustrated in FIG. 1, the substrate-type antenna 1 is provided with a substrate 10 including a substrate front surface 10A and a substrate back surface 10B, an arcuate antenna element 20, and an antenna-side coupler 30.

[Substrate]

Figure 2:
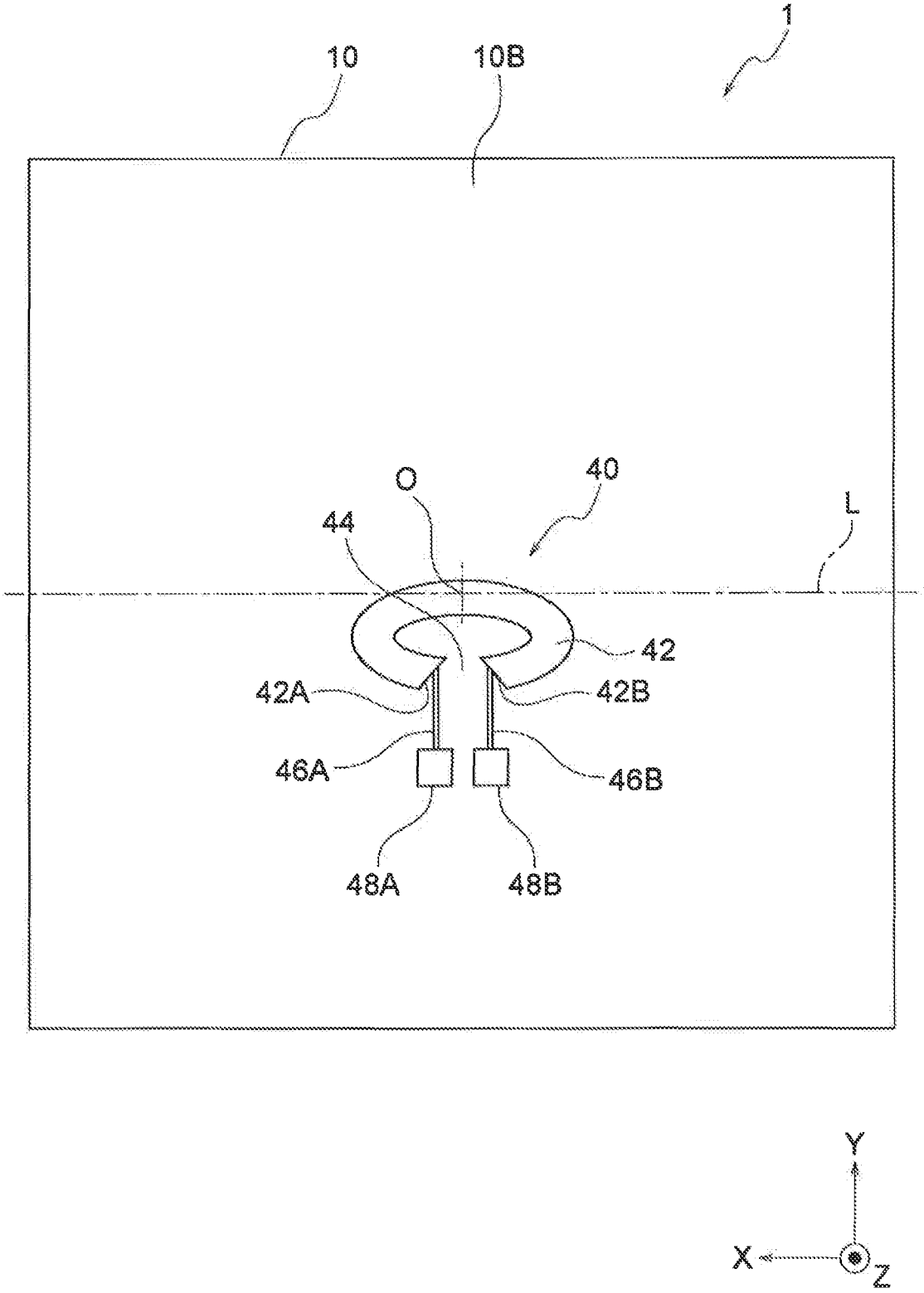
FIG. 2 is a back surface view illustrating a coupler of the substrate-type antenna for a global navigation satellite system according to the embodiment of the present invention.

As illustrated in FIG. 1 and FIG. 2, the substrate 10 includes the substrate front surface 10A and the substrate back surface 10B that is formed to face the substrate front surface 10A with predetermined thickness interposed therebetween. In the present embodiment, for example, the substrate 10 is formed into a plate shape and a base material of the substrate 10 is glass epoxy resin having a dielectric constant of 4.2. In the present embodiment, a glass epoxy resin plate of 34 mm (substrate width direction W)$^{x}$ 34 mm (substrate depth direction Y)×0.3 mm (substrate thickness direction Z) is used as the substrate 10. Each of FIG. 1 and FIG. 2 illustrates the substrate 10 in the shape of a square on a plan view. Meanwhile, the planar shape of the substrate 10 is not limited to a square but may be any shape. Here, the substrate front surface 10A is an example of one surface, and the substrate back surface 10B is an example of the other surface.

[Arcuate Antenna Element]

As illustrated in FIG. 1, the arcuate antenna element 20 is formed on the substrate front surface 10A. Each element configuring the arcuate antenna element 20 is formed concentrically around the center point O, and divided into a long arcuate antenna element 22 and a short arcuate antenna element 24.

In the present embodiment, the long arcuate antenna element 22 extends across an imaginary reference line L toward the substrate depth direction Y side. The long arcuate antenna element 22 has a distal end 22X that is one of the ends of the arc and a connection end 22Y that is the other one of the ends thereof. Here, the long arcuate antenna element 22 is an example of a first arcuate antenna element.

In the present embodiment, the short arcuate antenna element 24 is formed on the substrate depth direction Y side that is further than the imaginary reference line L in the substrate depth direction Y. The short arcuate antenna element 24 has a distal end 24X that is one of the ends of the arc and a connection end 24Y that is the other one of the ends thereof. The distal end 24X of the short arcuate antenna element 24 faces the connection end 22Y of the long arcuate antenna element 22 with a space interposed therebetween. The connection end 24Y of the short arcuate antenna element 24 faces the distal end 22X of the long arcuate antenna element 22 with a space interposed therebetween. Here, the short arcuate antenna element 24 is an example of a second arcuate antenna element.

[Relation Between Frequency Band and Antenna Element]

The substrate-type antenna 1 is compatible with QZSS, and not only receives radio waves in the L1 band (1575.42 MHz±15.35 MHz, also referred to as "L1"), the L2 band (1227.60 MHz±1.535 MHz, also referred to as "L2"), and the L5 band (1176.45 MHz±12.45 MHz, also referred to as "L5"), but also receives radio waves of the L6 band (1278.75 MHz±21 MHz, also referred to as "L6") which is unique to QZSS.

As illustrated in FIG. 1, the long arcuate antenna element 22 is configured with an arcuate integral antenna element on which an L5 corresponding element 22D corresponding to the three frequency bands of the L5 band, the L2 band, and the L6 band, an L2 corresponding element 22C, and an L6 corresponding element 22B are integrated in order from the outside with respect to the center point O. In addition, at a position spaced apart from the L6 corresponding element 22B of the integral antenna element in the direction toward the center point O, an L1 corresponding element 22A corresponding to the L1 band is formed. Here, the L1 corresponding element 22A is an example of a single antenna element.

The short arcuate antenna element 24 is configured with an arcuate integral antenna element on which an L5 corresponding element 24A corresponding to the three frequency bands of the L5 band, the L2 band, and the L6 band, an L2 corresponding element 24B, and an L6 corresponding element 24C are integrated in the order from the outside with respect to the center point O. In addition, at a position spaced apart from the L6 corresponding element 24C of the integral antenna element in the direction toward the center point O, an L1 corresponding element 24D corresponding to the L1 band is formed. Here, the L1 corresponding element 24D is an example of a single antenna element.

[Antenna-Side Coupler]

As illustrated in FIG. 1, the antenna-side coupler 30 has an imaginary center on an imaginary reference line that passes through the center point O and is perpendicular to the imaginary reference line L. The imaginary center above is positioned on the opposite side to the substrate depth direction Y side across the center point O. The antenna-side coupler 30 includes four elements that are formed in an ellipse and spaced from each other. A part of each four element is separated at a portion corresponding to the periphery of the center point O so as to provide a space, whereby an antenna-side gap 32 is formed therein. In other words, each four element is formed in an ellipse while the ellipse is divided around the imaginary center at a portion thereof on the substrate depth direction Y side. The four elements are respectively referred to as a first element 30A, a second element 30B, a third element 30C, and a fourth element 30D in the order from the outside of the imaginary center. A connection unit 34, which will be described later, connects the connection end 22Y of the long arcuate antenna element 22 and the connection end 24Y of the short arcuate antenna element 24 via each of the first element 30A, the second element 30B, the third element 30C, and the fourth element 30D at the antenna-side gap 32.

[Connection Unit]

As illustrated in FIG. 1, the connection unit 34 connects the antenna-side coupler 30, the long arcuate antenna element 22, and the short arcuate antenna element 24. Specifically, on the portion where the antenna-side gap 32 of the antenna-side coupler 30 is formed, one piece of the connection unit 34 forms the connection of the first element 30A by connecting the L1 corresponding element 22A of the long arcuate antenna element 22 and a portion corresponding to the L5 corresponding element 24A at the connection end 24Y of the short arcuate antenna element 24. In the same manner, another one piece of the connection unit 34 forms the connection of the second element 30B by connecting the L6 corresponding element 22B on the long arcuate antenna element 22 side to a portion corresponding to the L2 corresponding element 24B at the connection end 24Y of the short arcuate antenna element 24. Still another one piece of the connection unit 34 forms the connection of the third element 30C by connecting the L2 corresponding element 22C on the long arcuate antenna element 22 side to a portion corresponding to the L6 corresponding element 24C at the connection end 24Y of the short arcuate antenna element 24. The remaining one of the connection unit 34 forms the connection of the fourth element 30D by connecting the L5 corresponding element 22D on the long arcuate antenna element 22 side to a portion corresponding to the L1 corresponding element 24D at the connection end 24Y of the short arcuate antenna element 24.

In this way, the long arcuate antenna element 22 and the short arcuate antenna element 24 are connected to the antenna-side coupler 30 by the connection unit 34 having the four elements of the first element 30A, the second element 30B, the third element 30C, and the fourth element 30D, whereby the whole of which is formed as a dipole antenna type circularly polarized antenna.

In the present embodiment, a base material of the arcuate antenna element 20 is a copper foil, and the arcuate antenna element 20 is formed by etching the copper foil formed in advance on the substrate front surface 10A of the substrate 10. In FIG. 1, dashed lines are illustrated on the long arcuate antenna element 22 and the short arcuate antenna element 24 to show the corresponding frequency bands for the purpose of explanation. However, in practice, each of the long arcuate antenna element 22 and the short arcuate antenna element 24 is not formed with the elements that are divided for each frequency band and then integrated, but is integrally formed in advance with width corresponding to the three frequency bands by an etching technique.

[Power Feeding-Side Coupler]

As illustrated in FIG. 2, a feeding-side coupler 40 is formed on the substrate back surface 10B of the substrate 10. The feeding-side coupler 40 includes a feeding coupling element 42, a coupler-side gap 44, and a first terminal 48A and a second terminal 48B which serve as a feeding point.

[Feeding Coupling Element]

The feeding coupling element 42 is formed on a position of the substrate back surface 10B, which corresponds to the position of the substrate front surface 10A where the antenna-side coupler 30 is formed. The feeding coupling element 42 has an imaginary center on an imaginary reference line that is perpendicular to the imaginary reference line L at the center point O, which is on the opposite side to the substrate depth direction Y side across the center point O, and is formed into an ellipse including the coupler-side gap 44. The coupler-side gap 44 is formed by dividing a portion of the feeding coupling element 42 on the side opposite to the center point O across the imaginary center in the substrate depth direction Y. In other words, the feeding coupling element 42 is formed in an ellipse while a part of the ellipse is divided at a portion thereof on the side opposite to the substrate depth direction Y side with the imaginary center interposed therebetween.

[Feeding Point]

The feeding point includes the first terminal 48A and the second terminal 48B. Specifically, as illustrated in FIG. 2, the elliptical feeding coupling element 42 includes the coupler-side gap 44, thereby forming one end portion 42A and the other end portion 42B on the portions of the feeding coupling element 42, respectively. A first feeding line 46A and a second feeding line 46B are connected to the one end 42A and the other end 42B, respectively, and the first terminal 48A and the second terminal 48B are connected to the first feeding line 46A and the second feeding line 46B, respectively, whereby the whole of which configures the feeding point.

In the present embodiment, a base material of the feeding-side coupler 40 is a copper foil, and the feeding-side coupler 40 is formed by etching the copper foil formed in advance on the substrate back surface 10B of the substrate 10.

As described above, the arcuate antenna element 20 and the antenna-side coupler 30 are formed on the substrate front surface 10A, and the feeding-side coupler 40 is formed on the substrate back surface 10B, whereby the substrate-type antenna 1 is configured. In the following, a characteristic method of forming the arcuate antenna element 20 will be described.

<Method of Forming Antenna Element>

As described above, the antenna element 20 includes the long arcuate antenna element 22 and the short arcuate antenna element 24. As illustrated in FIG. 1, the long arcuate antenna element 22 extends in the counterclockwise direction about the center point O, from the connection end 22Y on the side opposite to the substrate width direction X side across the center point O, toward the distal end 22X on the substrate width direction X side that is positioned further than the center point O in the substrate width direction X. The short arcuate antenna element 24 extends in the counterclockwise direction about the center point O, from the connection end 24Y on the substrate width direction X side that is positioned further than the center point O in the substrate width direction X, toward the distal end 24X on the side opposite to the substrate width direction X side across the center point O. The whole of the long arcuate antenna element 22 and the short arcuate antenna element 24, each of which extends in the counterclockwise direction, serves as the arcuate antenna element 20 having left-hand circular polarization, whereby the dipole antenna type circularly polarized antenna is configured. The antenna element 20 is configured as above in order to be compatible with right-handed circularly polarized radio waves from a satellite. In other words, the substrate-type antenna 1 can be referred to as a left-handed circularly polarized antenna.

The length dimension of the long arcuate antenna element 22 and the short arcuate antenna element 24 is predetermined as a whole for each frequency to receive radio waves of each frequency from a satellite. On the other hand, the substrate-type antenna 1 is not used independently but used in a state of being accommodated in a casing of any type of device, such as in a casing of a portable terminal or in an antenna casing of an automobile, which is configured to receive radio waves from a satellite for use.

Generally, as a base material of such a casing, polycarbonate resin having a dielectric constant of approximately 2.4 is often used. The dielectric constant changes in accordance with, for example, the type and plate thickness of the base material of the casing. Accordingly, it is necessary to adjust the total length dimension of the long arcuate antenna element 22 and the short arcuate antenna element 24 in accordance with the dielectric constant of the material used for the casing.

In order to achieve the adjustment above, the total length dimension of the long arcuate antenna element 22 and the short arcuate antenna element 24 are set in advance shorter than one wavelength corresponding to each frequency in L1, L2, L5, L6. Then, for each frequency, a process of adjusting an axial ratio (AR) of an elliptically-polarized wave of the antenna, which will be described later, to 3 or less is performed by adjusting the length dimension of the long arcuate antenna element 22 or the short arcuate antenna element 24, or the length dimension of both of them. At the same time, when the impedance of the feeding point formed by the first terminal 48A and the second terminal 48B illustrated in FIG. 2 for each frequency band of L1, L2, L5, L6 is 50Ω, a process of further adjusting the length dimension of the long arcuate antenna element 22 or the short arcuate antenna element 24, or the length dimension of both of them is performed so that a voltage standing wave ratio (VSWR), which will be described later, is close to 1. In this connection, there may be a case where the length dimension or thickness of each piece of the connection unit 34, or both of them is adjusted. With these processes, it is possible to realize a multi-band circularly polarized antenna having no phase difference between each frequency band.

In the present embodiment, for example, when the substrate 10 of the substrate-type antenna 1 is made of glass epoxy resin as its base material and formed such that the dimension thereof in the substrate thickness direction Z (plate thickness) is 0.3 mm, and when the casing to which the substrate-type antenna 1 is attached is made of polycarbonate resin as its base material and formed such that the plate thickness thereof is 0.2 mm, the total length dimension of the long circular arcuate antenna element 22 and the short circular arcuate antenna element 24 is reduced at a reduction rate of about 80% to 90% of the original length dimension corresponding to one wavelength.

In this way, by adjusting the total length dimension of the long arcuate antenna element 22 and the short arcuate antenna element 24 so as to further increase the reception accuracy of radio waves from a satellite, it is possible to receive the radio waves at each frequency in L1, L2, L5, L6 with high accuracy. As a result, the substrate-type antenna 1 can exhibit high performance in receiving radio waves from GNSS (Global Navigation Satellite System).

<Operations of Main Portions>

Hereinafter, operations of main portions will be described mainly with reference to FIG. 3 to FIG. 9.

The antenna-side coupler 30 formed on the substrate front surface 10A and the feeding-side coupler 40 formed on the substrate back surface 10B face each other with the thickness of the substrate 10 therebetween. With this configuration, gain due to the radio waves received by the antenna element 20 for each frequency band of L1, L2, L5, L6 is combined at one portion where the antenna-side coupler 30 and the feeding-side coupler 40 face each other.

Figure 3:
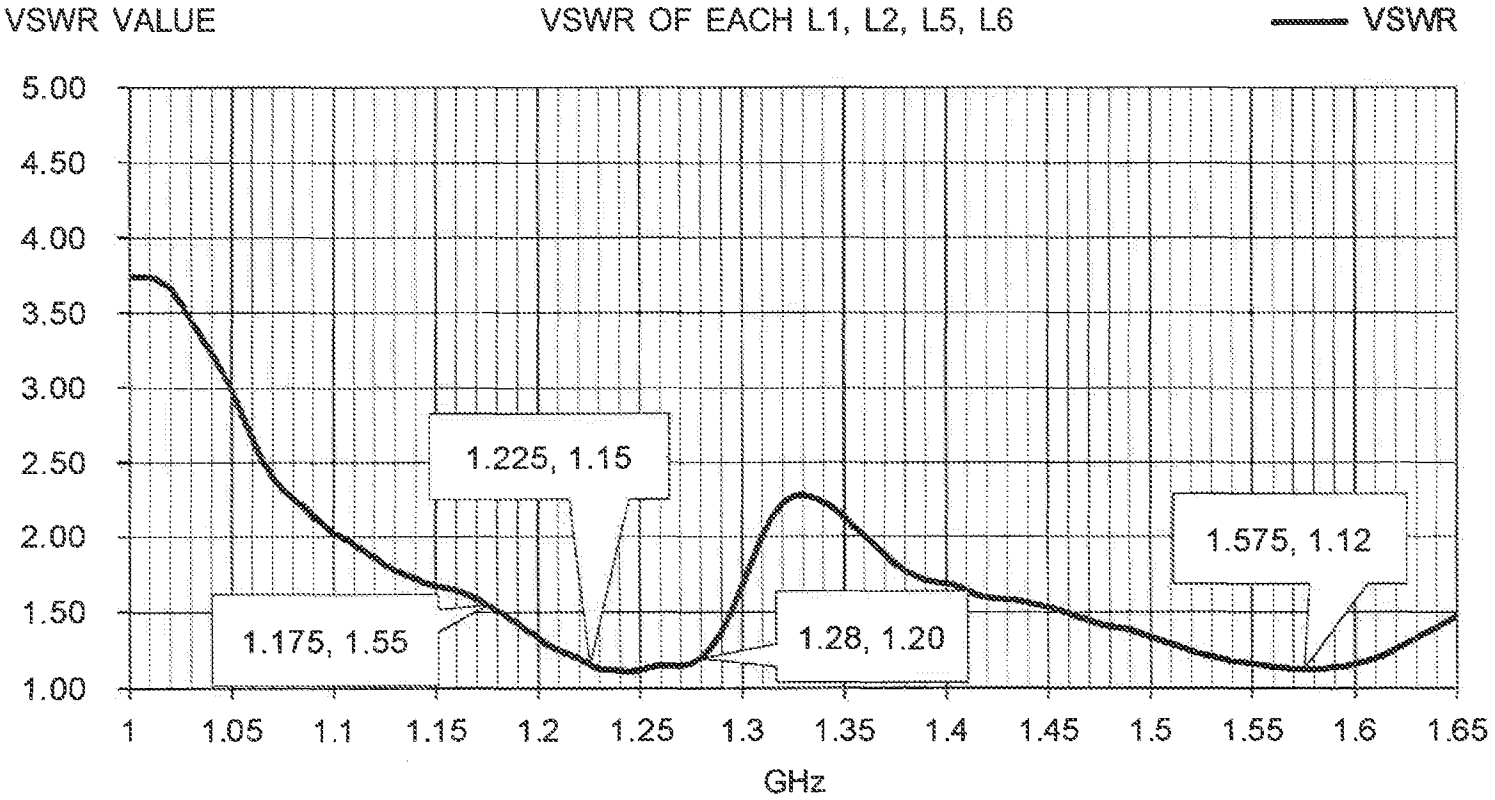
FIG. 3 illustrates a graph of a voltage standing wave ratio (VSWR value) of the substrate-type antenna for a global navigation satellite system according to the embodiment of the present invention (ratio of an incident wave and a reflected wave at a voltage).

FIG. 3 illustrates a graph showing the characteristics of a voltage standing wave ratio (hereinafter, referred to as "VSWR value") at each frequency in L1, L2, L5, L6, which are realized as a circularly polarized antenna, at the time of combining the gain due to the substrate-type antenna 1 of the present invention at one portion.

In FIG. 3, the horizontal axis represents the frequencies while the vertical axis represents the VSWR values. The graph illustrates the frequencies and the VSWR values of L5, L6, L2, L1 in the order from the lower frequency band. The squares illustrated in FIG. 3 correspond to frequency bands, respectively, and the numeral value on the left-side of each square represents its frequency while the numeral value on the right side represents its VSWR value. Accordingly, in L5, when the frequency is 1.175 GHz, the VSWR rate is 1.55. In L6, when the frequency is 1.225 GHz, the VSWR rate is 1.15. In L2, when the frequency is 1.280 GHz, the VSWR rate is 1.20. In L1, when the frequency is 1.575 GHz, the VSWR rate is 1.12. In FIG. 3, a unit of the frequencies is set to 5 MHz since the minimum unit of the measuring instrument used in the experiment is 5 MHz. Accordingly, the numeral value of each frequency in L1, L5, L6, L2 in FIG. 3 is an approximate value.

As illustrated in FIG. 3, according to the substrate-type antenna 1 of the present embodiment, it is possible to approximate a VSWR value at each frequency in L5, L6, L2, L1 to 1.

Figure 4:
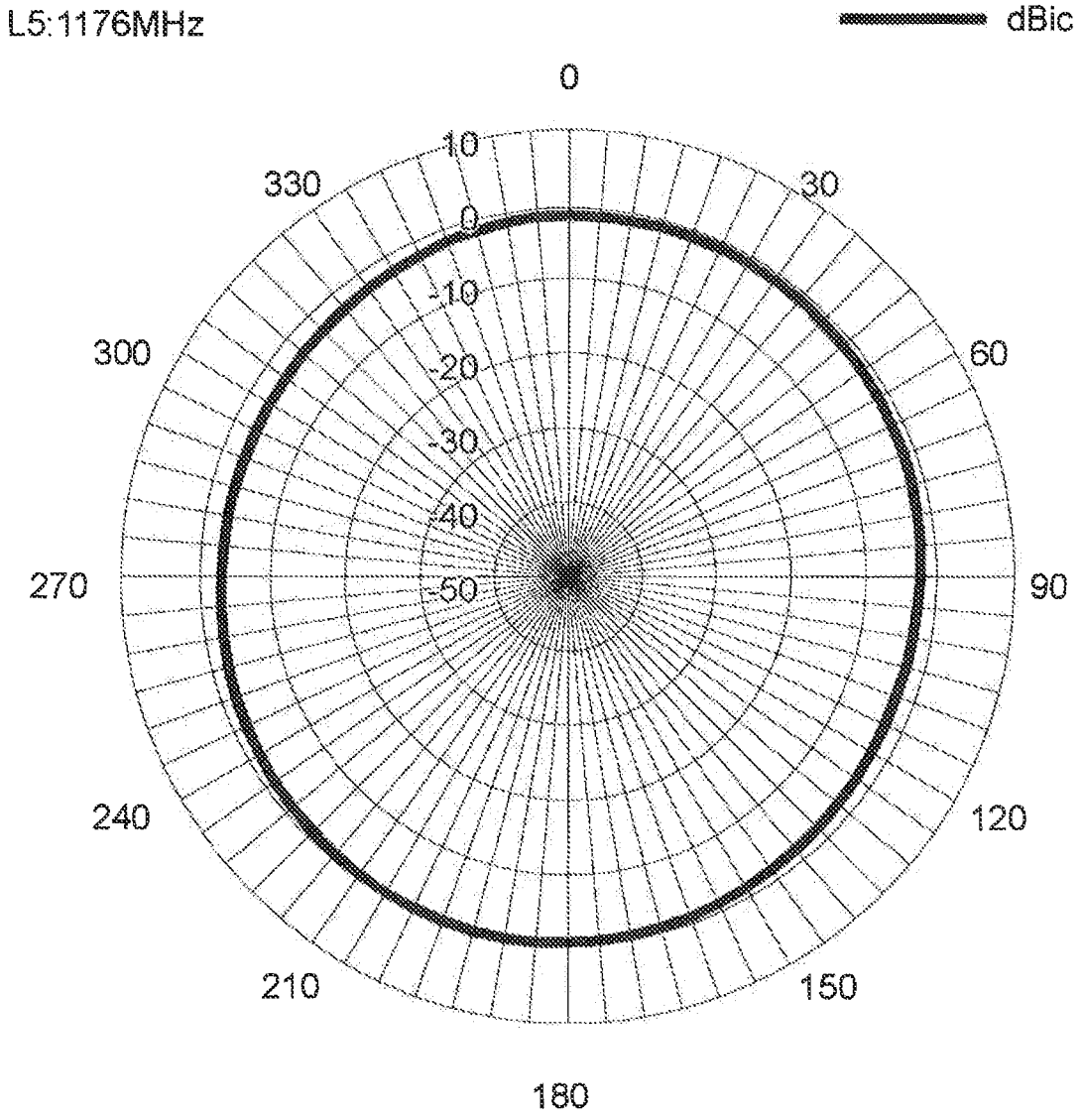
FIG. 4 illustrates radiation characteristics indicating gain (dBic value) in the L5 band of the substrate-type antenna for a global navigation satellite system according to the embodiment of the present invention.
Figure 5:
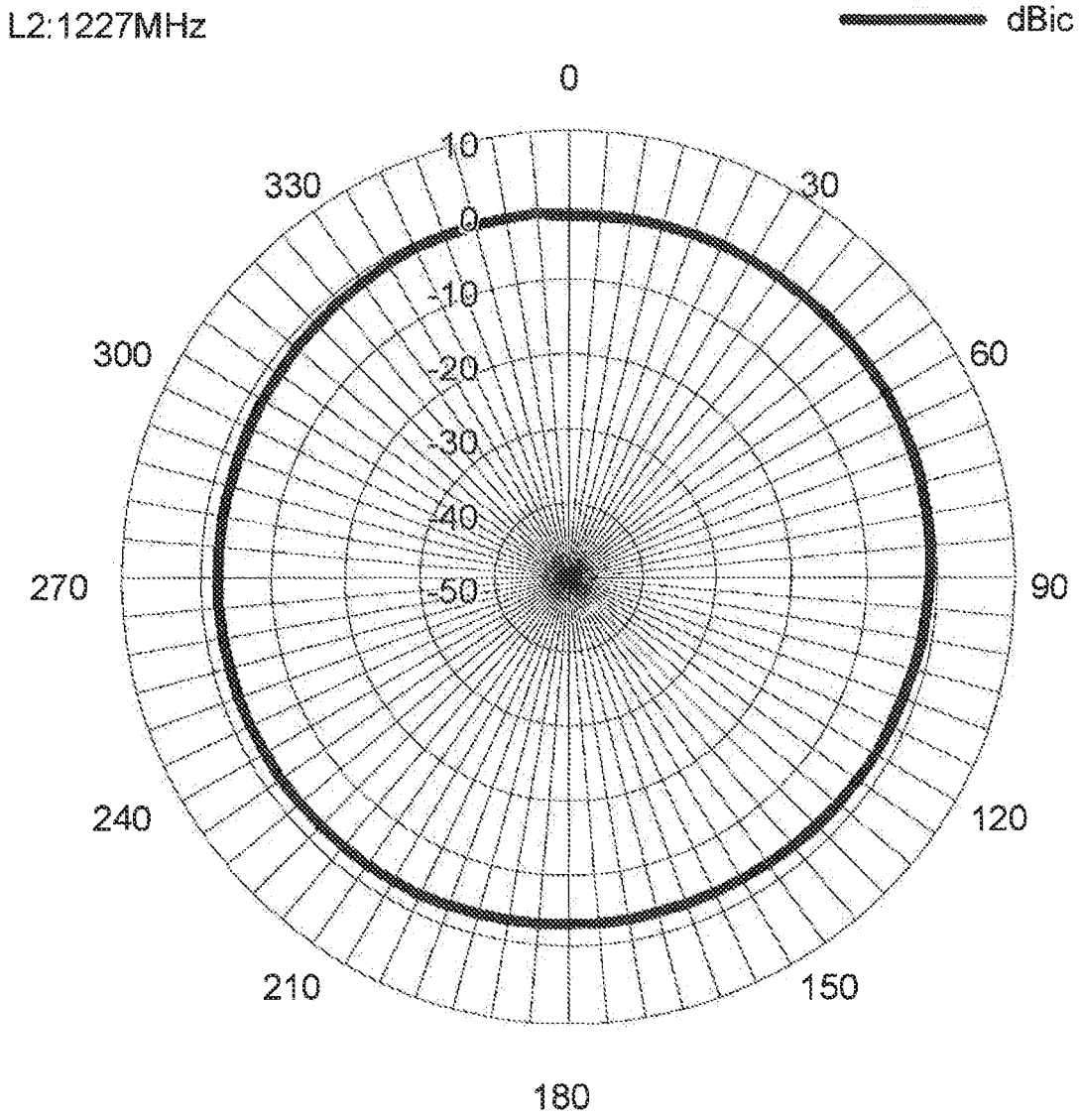
FIG. 5 illustrates radiation characteristics indicating gain (dBic value) in the L2 band of the substrate-type antenna for a global navigation satellite system according to the embodiment of the present invention.
Figure 6:
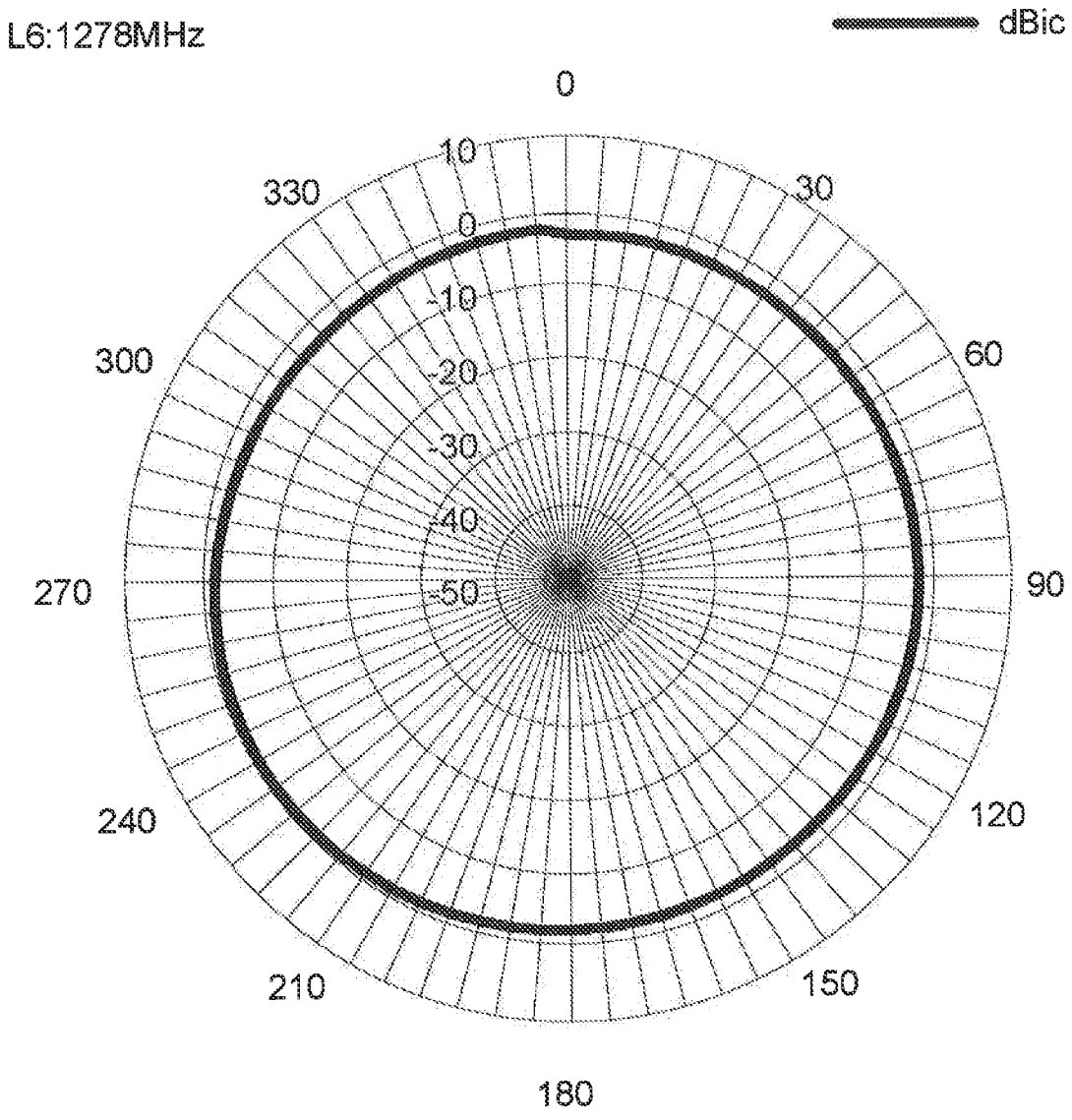
FIG. 6 illustrates radiation characteristics indicating gain (dBic value) in the L6 band of the substrate-type antenna for a global navigation satellite system according to the embodiment of the present invention.
Figure 7:
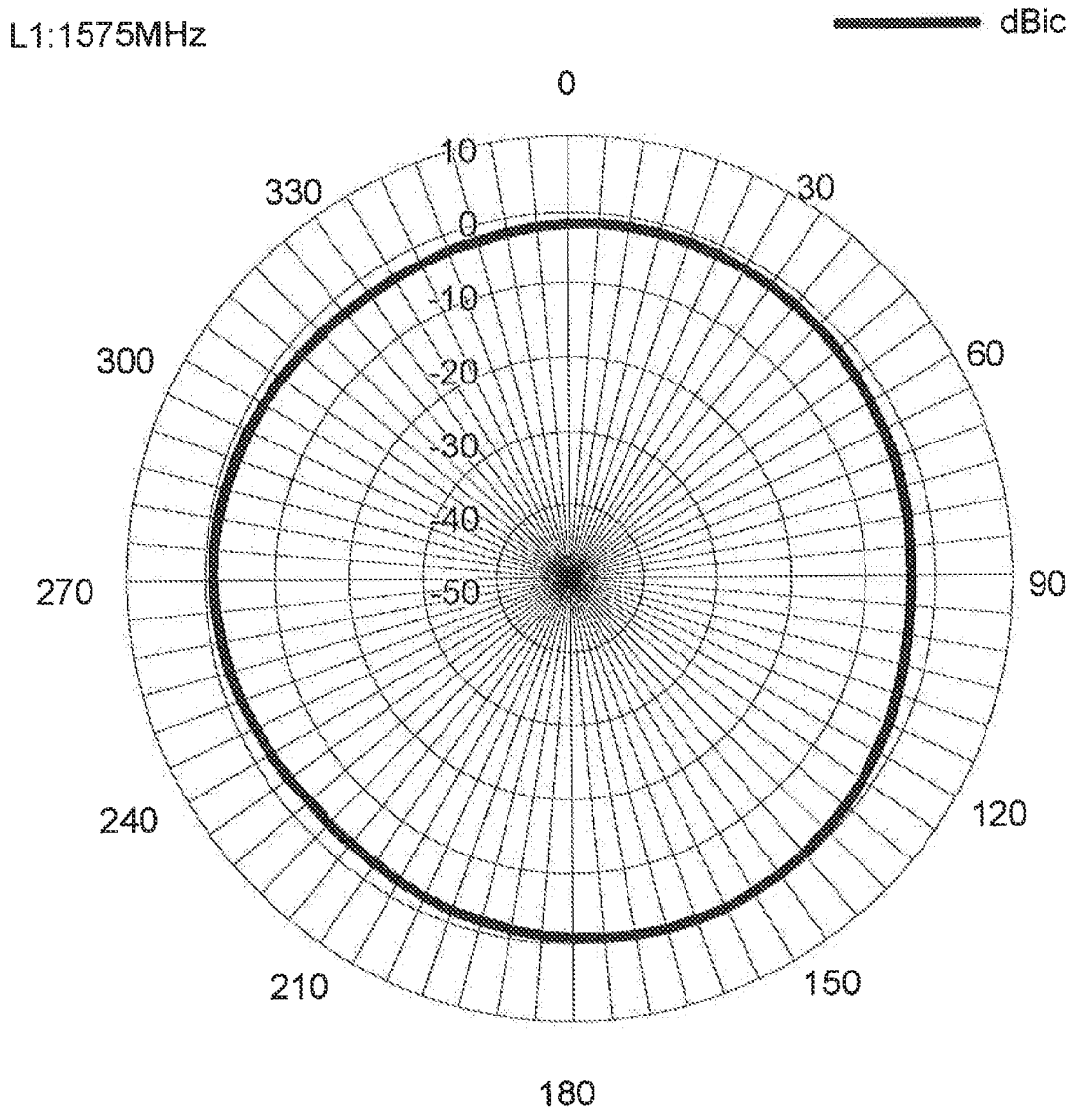
FIG. 7 illustrates radiation characteristics indicating gain (dBic value) in the L1 band of the substrate-type antenna for a global navigation satellite system according to the embodiment of the present invention.

FIG. 4 to FIG. 7 illustrate radiation characteristics for each frequency in L5, L6, L2, L1 according to the present embodiment. FIG. 4 illustrates the radiation characteristics of the frequency in L5, FIG. 5 illustrates the radiation characteristics of the frequency in L2, FIG. 6 illustrates the radiation characteristics of the frequency in L6, and FIG. 7 illustrates the radiation characteristics of the frequency in L1. At any frequency, radiation characteristics indicate a nearly circular shape, which reveals that, according to the present invention, stable performance can be obtained for each frequency.

Figure 8:
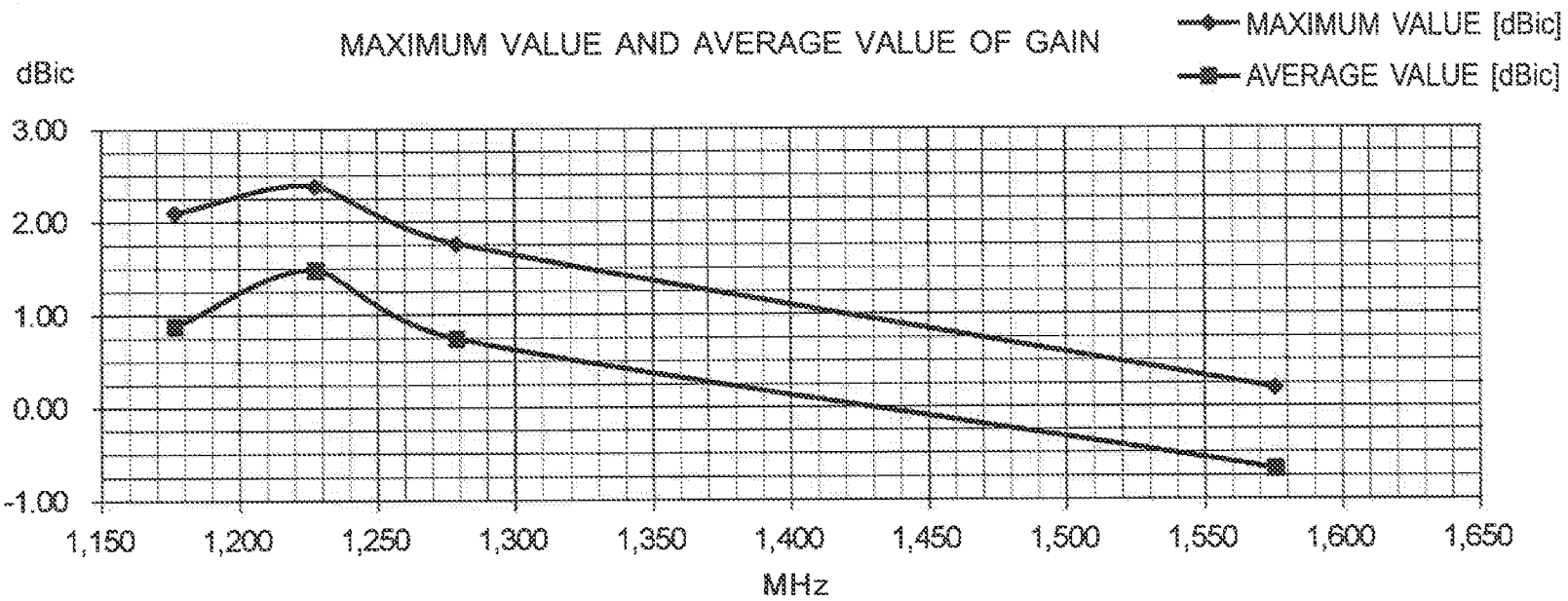
FIG. 8 illustrates a graph indicating a maximum value and an average value of gain in each four frequency band of the substrate-type antenna for a global navigation satellite system according to the embodiment of the present invention.

FIG. 8 illustrates a graph showing a maximum value and an average value of the gain in each four frequency band according to the present embodiment. The horizontal axis represents the frequencies while the vertical axis represents the gain due to circularly polarized waves. The graph illustrates the maximum values and the average values of the gain in L5, L6, L2, L1 in the order from the left side thereof. As illustrated in FIG. 8, there is no large variation in the gain at each frequency in L5, L6, L2, L1, which reveals that, according to the present invention, stable gain can be ensured as a whole.

FIG. 9 illustrates a table chart of a maximum value and an average value of the gain in each frequency illustrated in FIG. 8 while adding thereto an axial ratio (hereinafter, referred to as "AR") for each frequency. Generally, in the case of using circularly polarized waves, each AR thereof is required to be less than 3 dB. In the present embodiment, as illustrated in FIG. 9, the AR in each frequency in L5, L6, L2, L1 is less than 3 dB, which reveals that good circularly polarized waves can be obtained also in view of an AR (see also the radiation characteristics of each frequency illustrated in FIG. 4 to FIG. 7).

As described above, the substrate-type antenna 1 for a global navigation satellite system comprises a substrate 10 and an arcuate antenna element 20 that is compatible with a plurality of frequency bands. The arcuate antenna element is formed on a substrate front surface 10A of the substrate 10, divided into two elements, and arranged around a center point O of the substrate 10. The arcuate antenna element 20 includes a long arcuate antenna element 22 and a short arcuate antenna element 24. Each of the long arcuate antenna element 22 and the short arcuate antenna element 24 includes an integral antenna element that is compatible with three frequency bands and a single antenna element that is compatible with one frequency band and is arranged with a space from the integral antenna element. Each of the integral antenna element and the single antenna element is arranged to extend from an outer peripheral part of the arcuate antenna element toward an inner peripheral part thereof. The substrate-type antenna 1 further comprises a plurality of connection units 34 connected to a connection end 22Y of the long arcuate antenna element 22 and a connection end 24Y of the short arcuate antenna element 24, respectively, and an antenna-side coupler 30 to which the plurality of connection units 34 is coupled, so as to configure a dipole antenna type circularly polarized antenna.

With this configuration, it is possible to receive circularly polarized waves for QZSS having broad band characteristics and multi-band characteristics while reducing the phase difference.

The antenna-side coupler 30 has a shape of an ellipse, includes a first element 30A to a fourth element 30D each of which is arranged with a space therebetween, and is formed such that a part of each of the first element 30A to the fourth element 30D is divided and arranged with a space therebetween. The coupling portion is connected to the long arcuate antenna element 22 and the short arcuate antenna element 24, respectively, by the plurality of connection units 34.

With this configuration, it is possible to collectively combine the gain of the radio waves of four frequencies received by the substrate-type antenna 1 from a satellite at one portion, namely at the antenna-side coupler 30.

The substrate-type antenna 1 is provided with a feeding-side coupler 40 on the other surface 10B which is an opposite side of the one surface 10A so as to face the antenna-side coupler 30 so that gain received for each of the plurality of frequency bands is combined on the feeding-side coupler 40.

With this configuration, it is possible to collectively combine the gain due to the radio waves received by the substrate-type antenna 1 from a satellite at one portion, namely at the feeding-side coupler 40, and accordingly, the QZSS radio waves can be used with high accuracy. The gain combined at one portion is output to the feeding point formed by the first terminal 48A and the second terminal 48B. Furthermore, combination of the board-type antenna 1 and 5G technology can realize automatic driving of self-driving vehicles, and moreover, can realize control in remote control systems with higher accuracy than the one which does not make use of the radio waves in the L6 band.

It should be noted that the above-described embodiment of the antenna substrate 1 of the present invention is an example. The present invention is not limited thereto, and thus can be modified as various embodiments within the scope of the technical concept of the present invention. It is needless to say that the scope of the present invention is not limited to the embodiment described as an example.

For example, in the embodiment above, the dimension of the substrate 10 has been described as 34 mm×34 mm×0.3 mm, meanwhile, the dimension thereof is not limited thereto. The planar shape of the substrate 10 may be a circle or a rectangle as long as the shape and thickness of the substrate 10 allows formation of the antenna elements as a circularly polarized antenna.

Furthermore, in the embodiment above, the antenna-side coupler 30 has been described as having an imaginary center on an imaginary reference line that is perpendicular to the imaginary reference line L at the center point O, which is on the opposite side to the substrate depth direction Y side across the center point O. Meanwhile, the position of the antenna-side coupler 30 is not limited thereto, and it may be positioned to have an imaginary center on an imaginary reference line that does not pass through the center point O. In this case, the position of the feeding coupling element 42 of the feeding-side coupler 40 formed on the substrate back surface 10B may also be changed to a position corresponding to the moved position of the antenna side coupler 30.

REFERENCE SIGNS LIST

1 substrate-type antenna for a global navigation satellite system (substrate-type antenna)
10 substrate
10A substrate front surface (example of one surface)
10B substrate back surface (example of the other surface)
20 arcuate antenna element
22 long arcuate antenna element (example of first arcuate antenna element)
22A L1 corresponding element (single antenna element)
22B L6 corresponding element (example of integral antenna element formed by L2 corresponding element and L5 corresponding element)
22C L2 corresponding element (example of integral antenna element formed by L6 corresponding element and L5 corresponding element)
22D L5 corresponding element (example of integral antenna element formed by L6 corresponding element and L2 corresponding element)
22X distal end
22Y connection end
24 short arcuate antenna element (example of second arcuate antenna element)
24A L5 corresponding element (example of integral antenna element formed by L6 corresponding element and L2 corresponding element)
24B L2 corresponding element (example of integral antenna element formed by L6 corresponding element and L5 corresponding element)
24C L6 corresponding element (example of integral antenna element formed by L5 corresponding element and L2 corresponding element)
24D L1 corresponding element (example of single antenna element)
24X distal end
24Y connection end
30 antenna-side coupler (example of coupling portion)
30A first element (example of coupling element)
30B second element (example of coupling element)
30C third element (example of coupling element)
30D fourth element (example of coupling element)
32 antenna-side gap
34 connection unit
40 feeding-side coupler (example of feeding-side coupling portion)
42 feeding coupling element
42A one end
42B other end
44 coupler-side gap
46A first feeding line
46B second feeding line
48A first terminal
48B second terminal
O center point
L imaginary reference line

The invention claimed is:

1. A substrate-type antenna for a global navigation satellite system, the substrate-type antenna comprising:

a substrate; and an arcuate antenna element that is compatible with a plurality of frequency bands, the arcuate antenna element being formed on one surface of the substrate, divided into two elements, and arranged around a center point of the substrate, the arcuate antenna element including a first arcuate antenna element and a second arcuate antenna element, each of the first arcuate antenna element and the second arcuate antenna element including an integral antenna element that is compatible with three frequency bands and a single antenna element that is compatible with one frequency band and is arranged with a space from the integral antenna element, each of the integral antenna element and the single antenna element being arranged to extend from an outer peripheral part of the arcuate antenna element toward an inner peripheral part thereof, and the substrate-type antenna further comprising a plurality of connection units connected to one end of the first arcuate antenna element and one end of the second arcuate antenna element, respectively, and a coupling portion to which the plurality of connection units is coupled, so as to configure a dipole antenna type circularly polarized antenna.

2. The substrate-type antenna for a global navigation satellite system according to claim 1, wherein the coupling portion has a shape of an ellipse, includes a plurality of coupling elements each of which is arranged with a space therebetween, and is formed such that a part of each of the plurality of coupling elements is divided and arranged with a space therebetween, and the coupling portion is connected to the first arcuate antenna element and the second arcuate antenna element, respectively, by the plurality of connection units.

3. The substrate-type antenna for a global navigation satellite system according to claim 1 or claim 2, wherein a feeding coupling portion is provided on the other surface of the substrate which is an opposite side of the one surface so as to face the coupling portion, and gain received for each of the plurality of frequency bands is combined on the feeding coupling portion.

* * * * *